US007301427B2

(12) United States Patent
Chang

(10) Patent No.: US 7,301,427 B2
(45) Date of Patent: Nov. 27, 2007

(54) TRANSFORMER HAVING AUXILIARY WINDING COIL FOR SENSING MAGNETIC FLUX BALANCE AND DRIVING CIRCUIT USING THE SAME

(75) Inventor: Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 87 days.

(21) Appl. No.: 11/411,665

(22) Filed: Apr. 26, 2006

(65) Prior Publication Data

US 2007/0159284 A1 Jul. 12, 2007

(30) Foreign Application Priority Data

Jan. 11, 2006 (TW) ..... 95101080 A

(51) Int. Cl.
*H01F 27/28* (2006.01)

(52) U.S. Cl. ..... 336/170

(58) Field of Classification Search ..... 336/65, 336/83, 170, 178, 180–186, 200, 220–222; 315/262, 278, 57
See application file for complete search history.

(56) References Cited

U.S. PATENT DOCUMENTS 4,156,222 A * 5/1979 Rossman et al. ..... 336/61
5,053,738 A * 10/1991 Sato et al. ..... 336/165
6,794,976 B2 * 9/2004 Sigl ..... 336/170
2004/0046512 A1 * 3/2004 Suzuki et al. ..... 315/291
2005/0099143 A1 * 5/2005 Kohno ..... 315/312
2005/0280492 A1 * 12/2005 Kohno ..... 336/208
2006/0066246 A1 * 3/2006 Ushijima et al. ..... 315/57
2007/0139152 A1 * 6/2007 Chan et al. ..... 336/208

* cited by examiner

*Primary Examiner*—Tuyen T. Nguyen

(57) ABSTRACT

A transformer having auxiliary winding coils for sensing magnetic flux balance is disclosed. The transformer comprises a first winding part having a first channel, a second winding part having a second channel a third winding part having a third channel, a primary winding coil wound around the first winding part, a first secondary winding coil wound around the second winding part, a second secondary winding coil wound around the third winding part, a first auxiliary winding coil for sensing magnetic flux balance wound around the second winding part, a second auxiliary winding coil for sensing magnetic flux balance wound around the third winding part, and a magnetic core assembly having a first extension part disposed in the first channel, a second extension part disposed in the second channel, and a third extension part disposed in the third channel. The first and the second secondary winding coils couple to a plurality of lamps for providing energy to the plurality of lamps, and the first and the second auxiliary winding coils couple to a voltage detecting circuit for detecting if the energy provided to the plurality of lamps is substantially equal.

12 Claims, 2 Drawing Sheets

TRANSFORMER HAVING AUXILIARY WINDING COIL FOR SENSING MAGNETIC FLUX BALANCE AND DRIVING CIRCUIT USING THE SAME

FIELD OF THE INVENTION

The present invention relates to a transformer and a driving circuit using the transformer, and more particularly to a transformer having auxiliary winding coils for sensing magnetic flux balance and a driving circuit using the same.

BACKGROUND OF THE INVENTION

With the progress of technology, the panel display has been extensively used in the daily life. Take the liquid crystal display (LCD) panel as an example. The LCD panel mainly comprises an LCD module, a backlight module and a power module. The backlight module uses plural cold cathode fluorescent lamps (CCFL) or external electrode fluorescent lamps (EEFL) as light source, and these lamps are driven by a driving circuit called inverter.

Since the size of the LCD panel becomes larger and larger, the amount and size of the lamps are also increased. However, if the energy provided to each lamp is unequal, the LCD panel may have uneven brightness, and the lifespan of parts of the lamps might be shortened since their aging speed may be accelerated due to the unbalanced energy supply. For ensuring the even brightness of the LCD panel and preventing parts of the lamps from aging acceleratedly, it is needed to detect the current flowing through each lamp and further control it according to the balance state, so as to make the current flowing through each lamp equal. Nevertheless, the conventional detecting method is to couple one end of each lamp to a voltage detecting circuit directly for collecting the working current of each lamp. Then the voltage detecting circuit generates a detecting signal according the collected working current and delivers the detecting signal to a controller, and the controller controls and adjusts the output energy so as to balance the energy provided to each lamp. However, such method cannot accurately detect if the energy provided to each lamp is balanced or not.

Therefore, it is needed to provide a new detecting method to overcome the defects of the aforesaid prior art.

SUMMARY OF THE INVENTION

An object of the present invention is to provide a transformer having auxiliary winding coils for sensing magnetic flux balance and a driving circuit using the same. The present invention employs the transformer having the auxiliary winding coils coupled to the voltage detecting circuit for detecting if the energy provided to the plural lamps is substantially equal and executing proper controlling process, so as to ensure the even brightness of the LCD panel, prevent parts of the lamps from aging acceleratedly, and maintain the normal lifespan of the lamps.

According to an aspect of the present invention, there is provided a transformer having auxiliary winding coils for sensing magnetic flux balance. The transformer comprises a first winding part having a first channel, a second winding part having a second channel, a third winding part having a third channel, a primary winding coil wound around the first winding part, a first secondary winding coil wound around the second winding part, a second secondary winding coil wound around the third winding part, a first auxiliary winding coil for sensing magnetic flux balance wound around the second winding part, a second auxiliary winding coil for sensing magnetic flux balance wound around the third winding part, and a magnetic core assembly having a first extension part disposed in the first channel, a second extension part disposed in the second channel, and a third extension part disposed in the third channel. The first and the second secondary winding coils couple to a plurality of lamps for providing energy to the plurality of lamps, and the first and the second auxiliary winding coils couple to a voltage detecting circuit for detecting if the energy provided to the plurality of lamps is substantially equal.

In an embodiment, the magnetic core assembly comprises a first magnetic core and a second magnetic core. For example, the magnetic core assembly is an EE-core assembly. Each of the first magnetic core and the second magnetic core has the first extension part, the second extension part and the third extension part disposed in the first channel, the second channel and the third channel, respectively.

In an embodiment, the lamp is a cold cathode fluorescent lamp or an external electrode fluorescent lamp.

In an embodiment, a voltage difference exists between two ends of each of the first and the second auxiliary winding coils According to another aspect of the present invention, there is provided a driving circuit coupled to a plurality of lamps. The driving circuit comprises a controller, a transformer and a voltage detecting circuit. The controller provides power to the plurality of lamps. The transformer is coupled between the controller and the plurality of lamps for transforming voltage and providing voltage to the plurality of lamps. The transformer comprises a first winding part having a first channel, a second winding part having a second channel, a third winding part having a third channel, a primary winding coil wound around the first winding part, a first secondary winding coil wound around the second winding part, a second secondary winding coil wound around the third winding part, a first auxiliary winding coil for sensing magnetic flux balance wound around the second winding part, a second auxiliary winding coil for sensing magnetic flux balance wound around the third winding part, and a magnetic core assembly having a first extension part disposed in the first channel, a second extension part disposed in the second channel, and a third extension part disposed in the third channel. The voltage detecting circuit is coupled to the first and the second auxiliary winding coils and the controller for detecting if energy provided to the plurality of lamps is substantially equal and proving a detecting signal to the controller so that the controller controls the energy provided to the plurality of lamps in response to the detecting signal.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
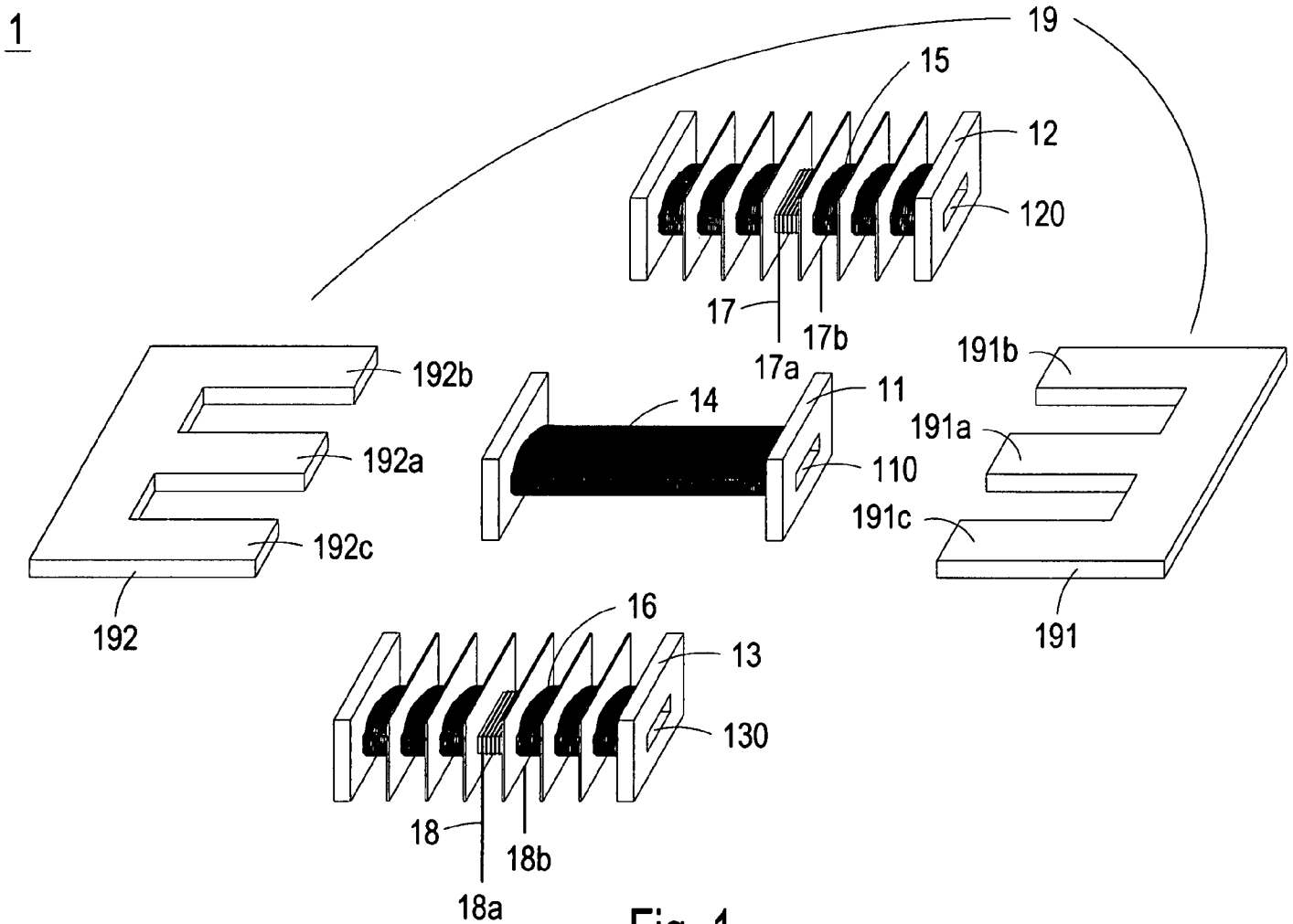
FIG. 1 is a schematic diagram showing a transformer having auxiliary winding coils for sensing magnetic flux balance according to the preferred embodiment of the present invention.

Please refer to FIG. 1, which is a schematic diagram showing the transformer having auxiliary winding coils for sensing magnetic flux balance according to the preferred embodiment of the present invention. As shown in FIG. 1, the transformer 1 comprises a first winding part 11, a second winding part 12, a third winding part 13, a primary winding coil 14, a first secondary winding coil 15, a second secondary winding coil 16, a first auxiliary winding coil 17 for sensing magnetic flux balance, a second auxiliary winding coil 18 for sensing magnetic flux balance, and a magnetic core assembly 19. The first winding part 11 has a winding area for winding the primary winding coil 14 therearound, the second winding part 12 has one or plural winding areas for winding the first secondary winding coil 15 therearound, and the third winding part 13 has one or plural winding areas for winding the second secondary winding coil 16 therearound. The first winding part 11, the second winding part 12 and the third winding part 13 have a first channel 110, a second channel 120 and a third channel 130, respectively. The magnetic core assembly 19 comprises a first magnetic core 191 and a second magnetic core 192, wherein each of the first and the second magnetic cores 191, 192 has a first extension part 191*a*, 192*a*, a second extension part 191*b*, 192*b*, and a third extension part 191*c*, 192*c*. The first extension parts 191*a*, 192*a* of the first and the second magnetic cores 191, 192 are disposed in the first channel 110, the second extension parts 191*b*, 192*b* of the first and the second magnetic cores 191, 192 are disposed in the second channel 120, and the third extension parts 191*c*, 192*c* of the first and the second magnetic cores 191, 192 are disposed in the third channel 130. The first auxiliary winding coil 17 for sensing magnetic flux balance is wound around the second winding part 12, and the second auxiliary winding coil 18 for sensing magnetic flux balance is wound around the third winding part 13. In addition, the primary winding coil 14, the first secondary winding coil 15 and the second secondary winding coil 16 can be wound around each winding part in phase or out of phase, and the number of turns thereof can be equal or unequal. Besides, the magnetic core assembly 19 can be an EE-core assembly, for example.

Figure 2:
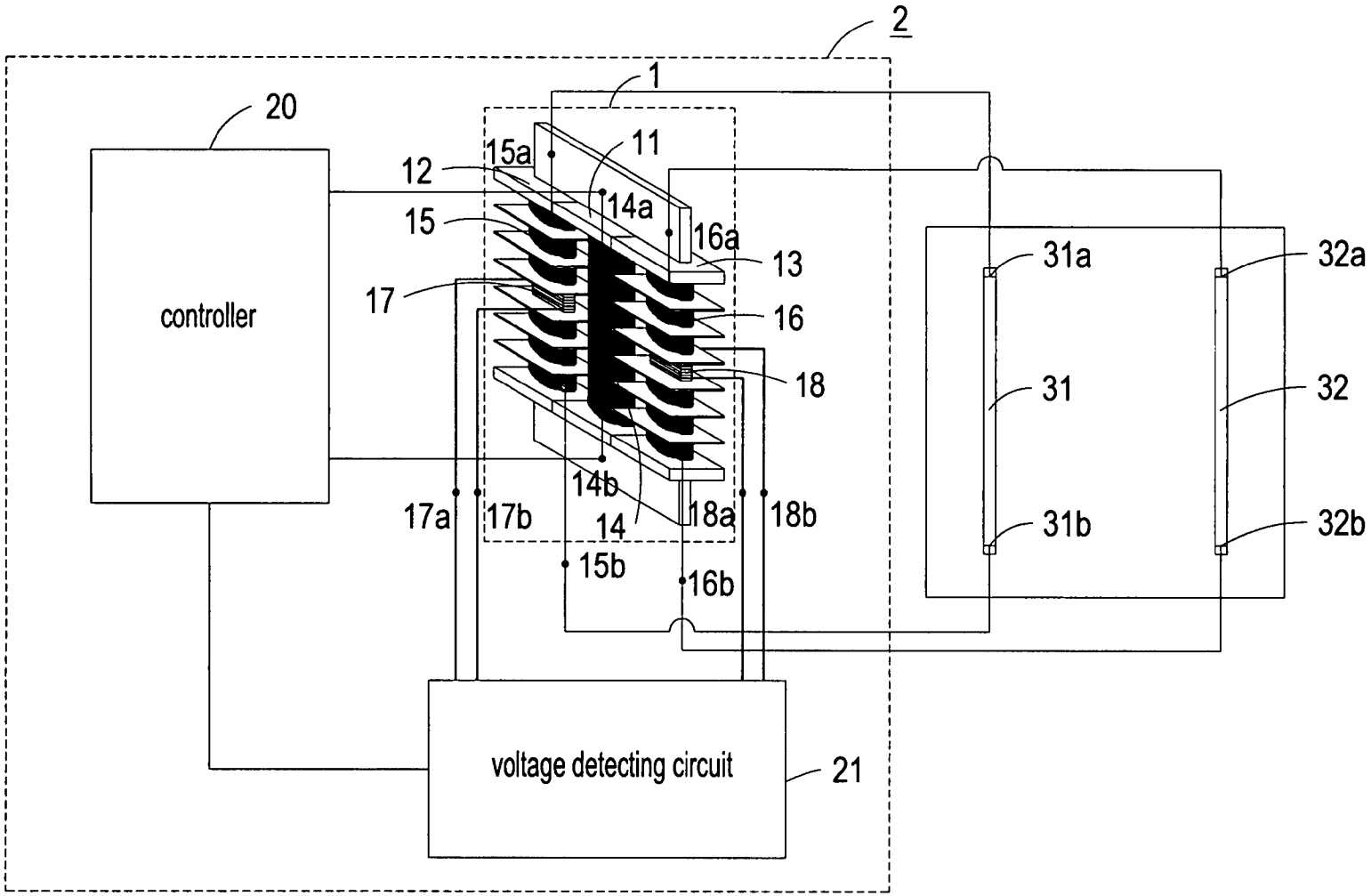
FIG. 2 is a schematic diagram showing a driving circuit using the transformer of FIG. 1.

Please refer to FIG. 2, which is a schematic diagram showing a driving circuit using the transformer of FIG. 1. As shown in FIG. 2, the transformer 1 can be used in a driving circuit 2 for driving a plurality of lamps. The driving circuit 2 comprises a transformer 1, a controller 20 and a voltage detecting circuit 21, and can be used to drive a plurality of lamps, such as a first lamp 31 and a second lamp 32. Please refer to FIGS. 1 and 2. The two ends 14*a*, 14*b* of the primary winding coil 14 wound around the first winding part 11 of the transformer 1 are coupled to the controller 20, so as to provide energy to the first lamp 31 and the second lamp 32 by the control of the controller 20 and the transformation of the transformer 1. In addition, each of the first secondary winding coil 15 and the second secondary winding coil 16 wound around the second winding part 12 and the third winding part 13 of the transformer 1 respectively has a first end 15*a*, 16*a*, and a second end 15*b*, 16*b*, wherein the first ends 15*a*, 16*a* are coupled to the first ends 31*a*, 32*a* of the first lamp 31 and the second lamp 32, respectively, and the second ends 15*b*, 16*b* are coupled to the second ends 31*b*, 32*b* of the first lamp 31 and the second lamp 32, respectively.

The two ends 17*a*, 17*b* of the first auxiliary winding coil 17 for sensing magnetic flux balance wound around the second winding part 12 and the two ends 18*a*, 18*b* of the second auxiliary winding coil 18 for sensing magnetic flux balance wound around the third winding part 13 are coupled to the voltage detecting circuit 21, respectively, wherein the voltage difference between the two ends 17*a*, 17*b* of the first auxiliary winding coil 17 for sensing magnetic flux balance is Δ V1, and the voltage difference between the two ends 18*a*, 18*b* of the second auxiliary winding coil 18 for sensing magnetic flux balance is Δ V2.

Since the energy provided to the first lamp 31 and the second lamp 32 shall be kept equal substantially, the magnetic flux $\psi_1$ passing the magnetic circuit between the primary winding coil 14 on the first winding part 11 and the first secondary winding coil 15 on the second winding part 12 shall be equal to the magnetic flux $\psi_2$ passing the magnetic circuit between the primary winding coil 14 on the first winding part 11 and the second secondary winding coil 16 on the third winding part 13, i.e.

$$\psi_1=\psi_2 \tag{1}$$

wherein $\psi_1$ represents the magnetic flux passing the magnetic circuit between the primary winding coil on the first winding part and the first secondary winding coil on the second winding part, and $\psi_2$ represents the magnetic flux $\psi_2$ passing the magnetic circuit between the primary winding coil on the first winding part and the second secondary winding coil on the third winding part.

Further, the magnetic flux is proportional to the product of voltage difference and time, i.e.

$$\psi=\Delta V\times T \tag{2}$$

wherein ψ represents the magnetic flux, Δ V represents the voltage difference, and T represents the time.

Therefore, if $\psi_1=\psi_2$, then Δ V1=Δ V2. That is to say, when the voltage detecting circuit 21 detects that the voltage difference Δ V1 between the two ends 17*a*, 17*b* of the first auxiliary winding coil 17 is equal to the voltage difference Δ V2 between the two ends 18*a*, 18*b* of the second auxiliary winding coil 18, it means the magnetic flux $\psi_1$ is equal to the magnetic flux $\psi_2$, so the energy provided to the first lamp 31 and the second lamp 32 is substantially equal and can be determined as normal. When the voltage detecting circuit 21 detects that the voltage difference Δ V1 between the two ends 17*a*, 17*b* of the first auxiliary winding coil 17 is unequal to the voltage difference Δ V2 between the two ends 18*a*, 18*b* of the second auxiliary winding coil 18, it means the magnetic flux $\psi_1$ is unequal to the magnetic flux $\psi_2$, so the energy provided to the first lamp 31 and the second lamp 32 is unequal and shall be determined as abnormal. Meanwhile, the voltage detecting circuit 21 delivers a detecting signal according to the detection and comparison result to the controller 20, and the controller 20 will control the energy provided to the first lamp 31 and the second lamp 32 in response to the detecting signal, so as to balance the current flowing to the plural lamps or execute other controlling process, such as stop the power supply to stop the light emitting of the lamps.

In conclusion, the present invention employs the transformer having the auxiliary winding coils coupled to the voltage detecting circuit for detecting if the energy provided to the plural lamps is substantially equal and executing proper controlling process, so as to ensure the even brightness of the LCD panel, prevent parts of the lamps from aging acceleratedly, and maintain the normal lifespan of the lamps.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer, comprising:

a first winding part having a first channel;

a second winding part having a second channel;

a third winding part having a third channel;

a primary winding coil wound around said first winding part;

a first secondary winding coil wound around said second winding part;

a second secondary winding coil wound around said third winding part;

a first auxiliary winding coil for sensing magnetic flux balance wound around said second winding part;

a second auxiliary winding coil for sensing magnetic flux balance wound around said third winding part; and a magnetic core assembly having a first extension part disposed in said first channel, a second extension part disposed in said second channel, and a third extension part disposed in said third channel;

wherein said first and said second secondary winding coils couple to a plurality of lamps for providing energy to said plurality of lamps, and said first and said second auxiliary winding coils couple to a voltage detecting circuit for detecting if said energy provided to said plurality of lamps is substantially equal.

2. The transformer according to claim 1 wherein said magnetic core assembly comprises a first magnetic core and a second magnetic core.

3. The transformer according to claim 2 wherein said magnetic core assembly is an EE-core assembly.

4. The transformer according to claim 2 wherein each of said first magnetic core and said second magnetic core has said first extension part, said second extension part and said third extension part disposed in said first channel, said second channel and said third channel, respectively.

5. The transformer according to claim 1 wherein said lamp is a cold cathode fluorescent lamp or an external electrode fluorescent lamp.

6. The transformer according to claim 1 wherein a voltage difference exists between two ends of each of said first and said second auxiliary winding coils.

7. A driving circuit coupled to a plurality of lamps, comprising:

a controller providing power to said plurality of lamps;

a transformer coupled between said controller and said plurality of lamps for transforming voltage and providing voltage to said plurality of lamps, said transformer comprising:

a first winding part having a first channel;

a second winding part having a second channel;

a third winding part having a third channel;

a primary winding coil wound around said first winding part;

a first secondary winding coil wound around said second winding part;

a second secondary winding coil wound around said third winding part;

a first auxiliary winding coil for sensing magnetic flux balance wound around said second winding part;

a second auxiliary winding coil for sensing magnetic flux balance wound around said third winding part; and a magnetic core assembly having a first extension part disposed in said first channel, a second extension part disposed in said second channel, and a third extension part disposed in said third channel; and a voltage detecting circuit coupled to said first and said second auxiliary winding coils and said controller for detecting if energy provided to said plurality of lamps is substantially equal and proving a detecting signal to said controller so that said controller controls said energy provided to said plurality of lamps in response to said detecting signal.

8. The driving circuit according to claim 7 wherein said magnetic core assembly comprises a first magnetic core and a second magnetic core.

9. The driving circuit according to claim 8 wherein said magnetic core assembly is an EE-core assembly.

10. The driving circuit according to claim 8 wherein each of said first magnetic core and said second magnetic core has said first extension part, said second extension part and said third extension part disposed in said first channel, said second channel and said third channel, respectively.

11. The driving circuit according to claim 7 wherein said lamp is a cold cathode fluorescent lamp or an external electrode fluorescent lamp.

12. The driving circuit according to claim 7 wherein a voltage difference exists between two ends of each of said first and said second auxiliary winding coils.

* * * * *